US005480697A

United States Patent [19]

Böttger et al.

[11] Patent Number: 5,480,697

[45] Date of Patent: Jan. 2, 1996

[54] STRUCTURAL PART BASED ON A SANDWICH FABRIC

[75] Inventors: Wolfgang Böttger, Ködnitz; Werner Pensel, Kulmbach, both of Germany

[73] Assignee: Vorwerk & Co. Interholding GmbH, Wuppertal, Germany

[21] Appl. No.: 43,966

[22] Filed: Apr. 8, 1993

Related U.S. Application Data

[63] Continuation of Ser. No. 818,808, Jan. 9, 1992, abandoned.

[30] Foreign Application Priority Data

Jan. 12, 1991 [DE] Germany ..... 41 00 738.7

[51] Int. Cl.[6] ..... B32B 3/02; B32B 5/12; B32B 7/00

[52] U.S. Cl. ..... 428/86; 428/34.7; 428/36.1; 428/96; 428/111; 428/112; 428/119; 428/120; 428/223; 428/255; 428/257

[58] Field of Search ..... 428/86, 96, 111, 428/112, 119, 120, 223, 255, 36.1, 34.7, 257

[56] References Cited

U.S. PATENT DOCUMENTS

| | | | |
|---|---|---|---|
| 1,223,538 | 4/1917 | Tully | 428/96 X |
| 1,708,043 | 4/1929 | Bancroft | 428/96 X |
| 1,759,976 | 5/1930 | Cummings | 428/86 |
| 2,072,152 | 3/1937 | Blake et al. | 139/408 |
| 2,356,456 | 8/1944 | Garner | 428/119 |
| 2,713,012 | 7/1955 | Hartstein | 428/95 X |
| 2,762,739 | 9/1956 | Weiss | 428/111 |
| 2,803,268 | 8/1957 | MacIntire | 428/119 |
| 3,015,149 | 1/1962 | Foster et al. | 428/95 |
| 3,138,506 | 6/1964 | Ross | 428/116 |
| 3,207,185 | 9/1965 | Koppelman et al. | 428/119 |
| 3,481,427 | 11/1968 | Dobbs et al. . | |
| 3,506,479 | 4/1970 | Breens | 428/96 X |
| 4,172,916 | 10/1979 | Watson | 428/119 |
| 4,389,447 | 6/1983 | Disselbeck et al. | 428/223 |
| 4,452,657 | 6/1984 | Hamm | 428/119 |
| 4,569,883 | 2/1986 | Renjilian | 428/257 |
| 4,840,828 | 6/1989 | Böttger et al. | 428/120 |
| 4,888,228 | 12/1989 | Sidles | 428/96 X |
| 4,906,502 | 3/1990 | Rudy | 428/86 X |
| 4,971,642 | 11/1990 | Schwan | 428/257 |
| 4,983,433 | 1/1991 | Shirasaki | 428/36.1 |
| 5,160,485 | 11/1992 | Jaillet et al. | 428/257 |
| 5,164,237 | 11/1992 | Kaneda et al. | 428/34.7 |
| 5,175,034 | 12/1992 | De La Porte et al. | 428/36.1 |
| 5,238,728 | 8/1993 | Aucagne | 428/257 |
| 5,262,230 | 11/1993 | Becker et al. | 428/254 |

FOREIGN PATENT DOCUMENTS

| | | | |
|---|---|---|---|
| 674154 | 11/1963 | Canada | 428/86 |
| 3540455 | 5/1987 | Germany | 428/113 |

*Primary Examiner*—George F. Lesmes
*Assistant Examiner*—Terrel Morris
*Attorney, Agent, or Firm*—Martin A. Farber

[57] ABSTRACT

A structural part having as its basis a sandwich fabric, in particular a velour fabric, having at least a first layer (a) and a second layer (b) and intermediate links connecting said layers (a, b), in which connection the fabric consists of a technical yarn such as aramid fiber, carbon fiber, ceramic fiber or, in particular, glass fiber, is resinified and cured, and the intermediate links form rigid spacing elements for the first and second layers (a, b). In order to be able to produce, in particular, structural parts which have a strong curvature, at least one of the layers (a, b) be woven in an open weave, such as used also in multi-layer fabrics.

8 Claims, 5 Drawing Sheets

STRUCTURAL PART BASED ON A SANDWICH FABRIC

RELATED APPLICATION

This application is a continuation of our application Ser. No. 07/818,808 filed Jan. 9, 1992 now abandoned.

FIELD AND BACKGROUND OF THE INVENTION

The present invention relates to a structural part based on a sandwich fabric, particularly a velour fabric, having at least one first layer and intermediate links connecting said layers, in which the fabric consists of a high-tenacity yarn, such as aramid fiber, carbon fiber, ceramic fiber or, in particular, glass fiber. The fabric is impregnated with resin and cured, and the intermediate links form spacing elements between the first and second layers.

Such a structural part is known, for instance, from European Patent EP-A3-299 308 and its corresponding U.S. Pat. No. 4,840,828. In that case, the upper and lower layers are of the same weave. Such a structural part has proven satisfactory, but it is still capable of improvement for various uses, in particular in the case of strong curvature of the structural part, since in this case the inner layer tends to form wrinkles.

SUMMARY OF THE INVENTION

Proceeding from the prior art described above, the object of the present invention is to provide a structural part having a base of a velour fabric of the type described above which is suitable, in particular, for uses in which strong curvature is required.

According to the invention at least one of the layers is woven with an open weave. Open weave as used here means, for instance, that each warp thread alternates through several filling (weft) layers. With this type of weave, in which the layer having the open weave is arranged on the inside of the curvature, it is possible to produce curved parts on the basis of such a velour fabric in which, even in the event of stronger curvatures, there is no tendency towards wrinkling or the formation of wrinkles on the inner side. The weave selected for the inner layer permits the shrinking of the fabric in the warp direction by undulated displacement of the warp threads towards the inside or outside. The warp threads, in curved, cured state, as a result are in part freely stretched in arched shape. Seen by itself, the layer with the open weave is a multi-layer fabric. The particular advantage of this fabric also resides in the fact that, due to the possibility of the shrinking of the inner layer, the height of the sandwich fabric, namely the sandwich height, can be maintained constant over the entire angular periphery of a structural part. This is not possible with the sandwich fabrics of the type known up to the present time. Otherwise, the properties of the structural part mentioned at the start are substantially retained. The aforementioned United States patent is hereby incorporated by reference in its entirety. In the development thereof, it is provided that the intermediate links are formed by spacer threads in the form of a pile through-binding or on-binding. As a whole, they extend approximately in the shape of a W through the fabric. By means of such a structural part, it is possible to wrap pipes, boilers and tanks for instance, with the woven material. After the wrapping, the resin is applied and the cured structural part with spaced layers is obtained. Another possibility consists of pre-impregnating the fabric with resin and applying it in wet condition to a mold or a base body. Although it is first of all described here as preferred embodiment that one of the two layers, namely the inner layer, is developed as multi-layer fabric with open weave, the invention however also covers the development of both layers in the form of the multi-layer fabric with open weave. In this way, the drapability of a sandwich fabric is further substantially improved.

The invention is further described below on basis of the accompanying drawing, which however merely shows examples of embodiments.

DETAILED DESCRIPTION OF THE PREFERRED EMBODIMENT

Figure 1:
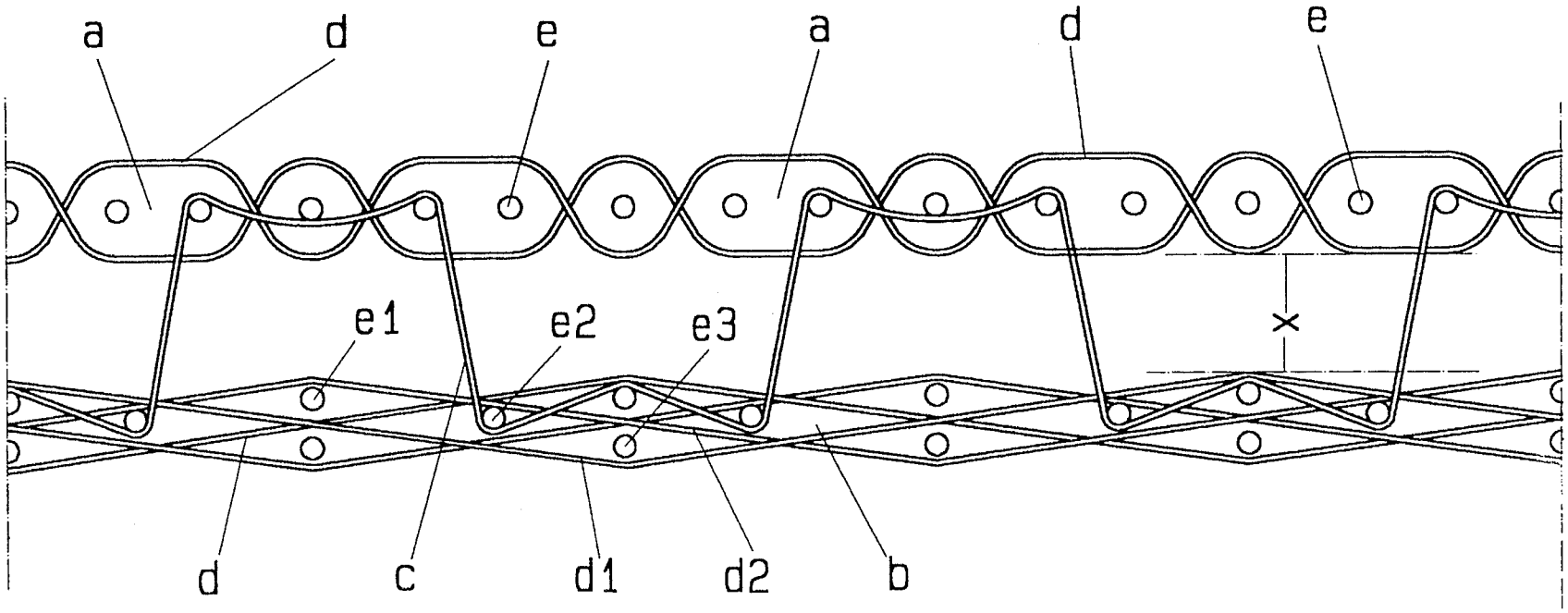
FIG. 1 shows diagrammatically the arrangement of a weave for a structural part based on a velour sandwich fabric.

FIG. 1 diagrammatically shows a sandwich fabric such as can be used for a structural part concerned here. Two layers a and b can be noted, held together by a connecting thread c. The upper layer a is formed by a ⅜-filling/pile through weave, while the lower layer consists of a multi-layer fabric having at least three warp and four filling layers. Herein, the preceding term "⅜" means that the thread c, which passes between the fabric layers to form links between the layers, alternates as a warp thread by alternating among three weft threads in one of the layers, and then alternates as a warp thread by alternating among three weft threads in a second of the layers, this giving a periodicity of six weft threads e as shown in FIG. 1. The pile threads c which form the intermediate links are bound in pile through binding into the lower layer b. The filling threads are designated as e and e1 to e3 in the drawing; the warp threads by d and d1 and d2.

Figure 3:
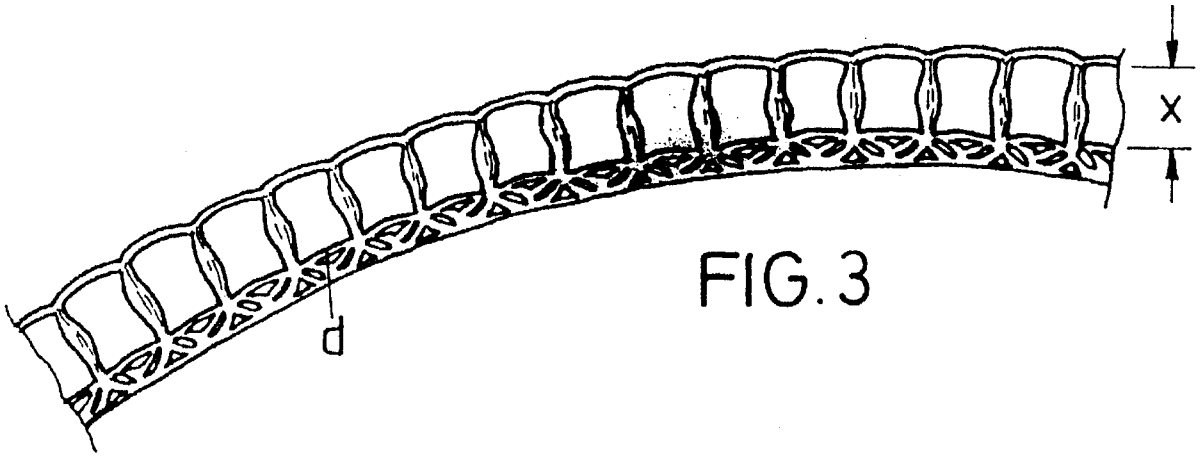
FIG. 3 is a simplified showing of a cured structural part having a fabric basis in accordance with FIGS. 1 and 2.
Figure 4:
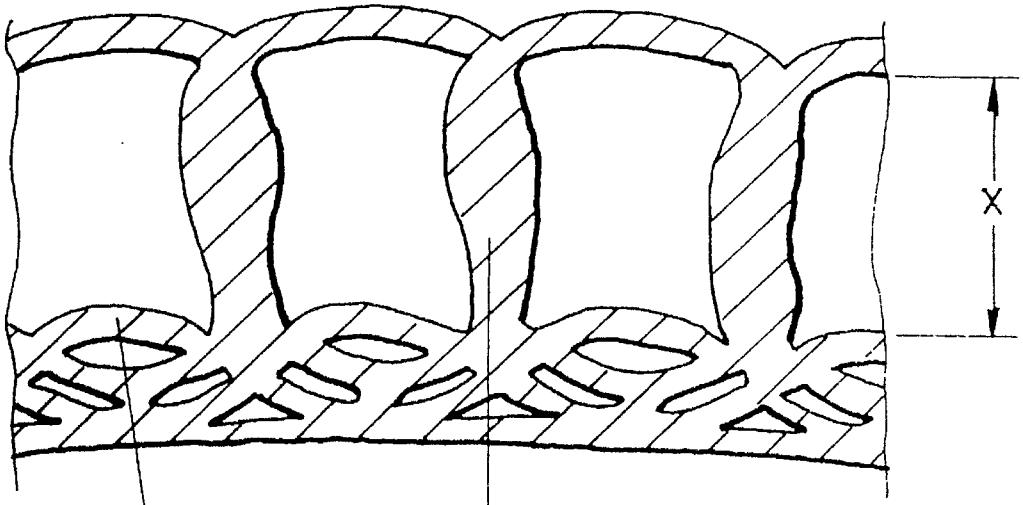
FIG. 4 is an enlarged detail showing of the object of FIG. 3.

The distance x between layers amounts to, for instance, about 2–20 mm in the case of an actual structural part (FIGS. 3 and 4).

As can be noted in particular from FIG. 3, in cured state the warp threads d extend in the lower layer in part freely stretched rigid and arched. In particular, the arches protrude into the inside and therefore facing the outer layer a of the sandwich fabric. The free stretching is dependent on the curing. The latter, however, is so selected that after the curing the fabric opens up correctly, i.e. without further aids, after the curing, and automatically forms the spacing x. For this, any excess resin can be removed possibly by being squeezed out.

Figure 2:
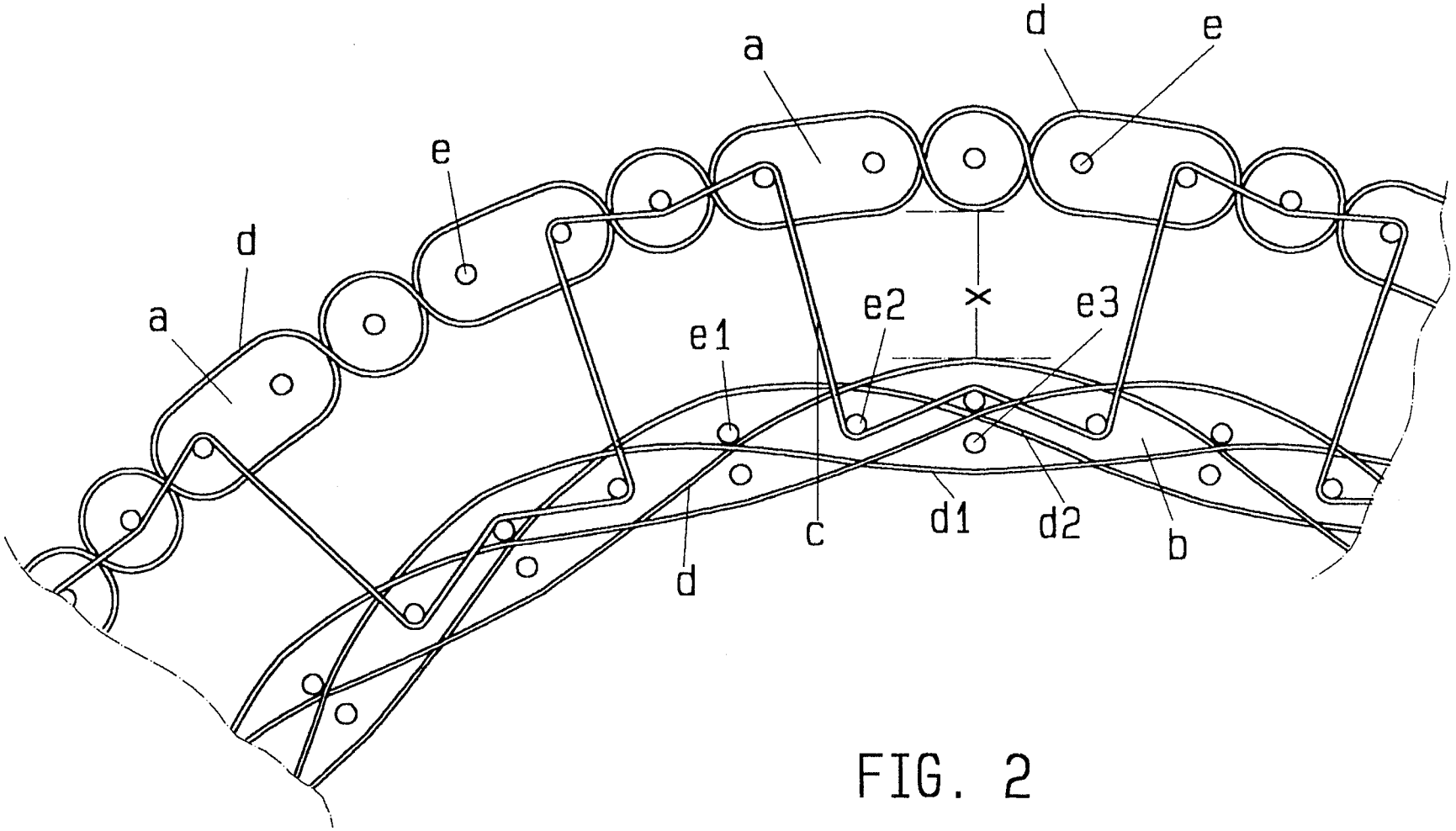
FIG. 2 is a diagrammatic view of the fabric of FIG. 1, curved.

It is clear, in particular from a comparison of FIGS. 1 and 2 that, upon a curving of the fabric, the warp threads d of the lower layer curve inward and outward and thus, in cured state, assume the arcuately stretched course shown, for instance, in FIGS. 3 and 4.

Figure 5:
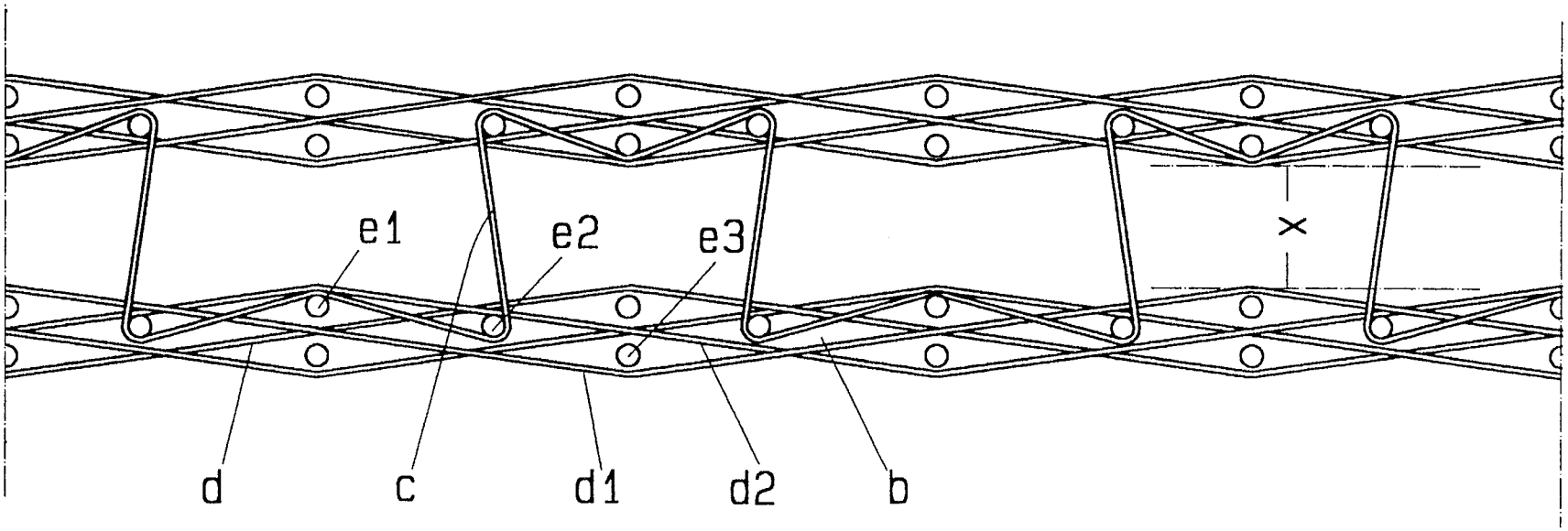
FIG. 5 is a stylized fragmentary sectional view of a fabric having a first layer and a second layer constructed of open weave.
Figure 6:
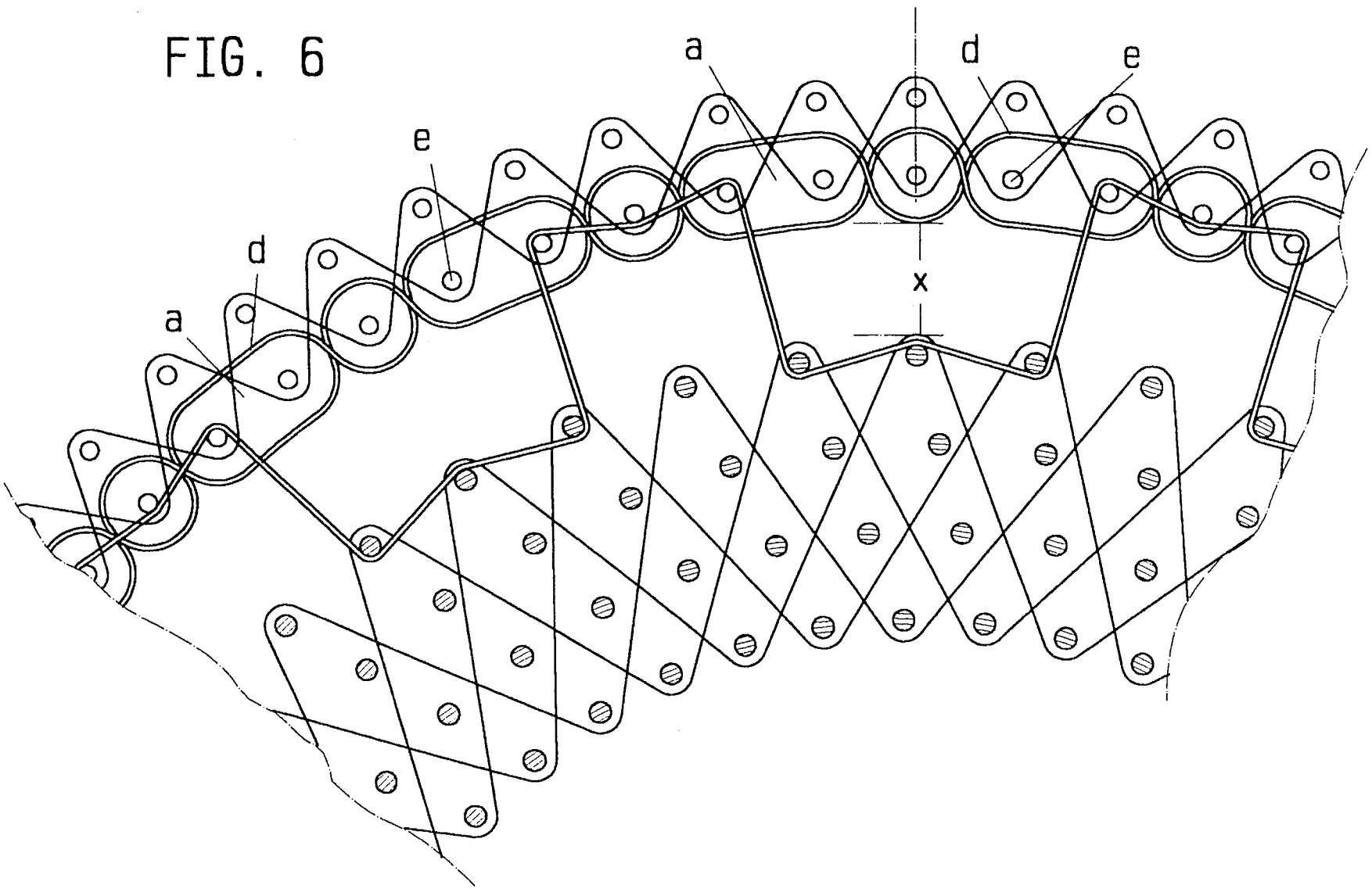
FIG. 6 is a stylized fragmentary sectional view of a fabric having a first layer and a second layer constructed of open weave, and wherein each of the layers is itself a multiple layer fabric.

FIG. 5 is a sectional view of a fabric having a first layer and a second layer constructed of open weave, each fabric layer having a construction following the construction of the inner fabric layer of FIG. 2. In FIG. 6, each of the inner and the outer fabric layers is an open weave having multiple layer construction.

The features of the invention disclosed in the above description, the drawing and the claims may be of importance, both individually and in any desired combination, for the reduction to practice of the invention. All features disclosed are essential to the invention.

We claim:

1. A structural part having a curvature and including a laminar fabric, said laminar fabric comprising at least one first fabric layer and at least one second fabric layer and intermediate links connecting said at least one first layer and said at least one second layer, the laminar fabric being composed of a high tenacity yarn of a fiber selected from the group consisting of aramid, carbon, ceramic, and glass fibers;

wherein, said laminar fabric is impregnated with a resin, the resin is cured, and said intermediate links serve as rigid spacing elements between said at least one first layer and said at least one second layer;

said at least one second layer is woven in an open weave;

said open weave is curved and comprises a plurality of warp threads and a plurality of filling layers of weft threads and, said open weave provides that each of said warp threads alternates through a plurality of said filling layers of weft threads;

said at least one first layer comprises weft threads and warp threads which alternate through the weft threads of said at least one first layer; and said intermediate links comprise further threads which enter into said open weave and alternate as warp threads among weft threads of said open weave, said further threads entering into said at least one first layer and alternating as warp threads among weft threads of said at least one first layer.

2. A structural part, according to claim 1, wherein prior to curing the open weave permits a shrinking of the fabric in the warp direction without the formation of wrinkles in an open weave layer along the inside of the curvature.

3. A structural part according to claim 1, wherein said at least one first layer is woven in a closed weave, and the open weave is located on an inner side of said curvature.

4. A structural part, according to claim 1, wherein said at least one first layer and said at least one second layer are woven in open weave.

5. A structural part, according to claim 1, wherein said at least one first layer or said at least one second layer or both a first layer and a second layer are, in themselves, multi-layer fabrics.

6. Structural element having a curvature and comprising a laminar fabric including a first fabric layer and a second fabric layer and intermediate links connecting said first layer and said second layer, the laminar fabric being composed of a high tenacity yarn of a fiber selected from the fiber group consisting of aramid, carbon, ceramic, and glass fibers;

wherein said laminar fabric is impregnated with a resin, the resin is cured, said intermediate links serve as form rigid spacing elements between said first layer and said second layer;

said second layer is woven in an open weave;

said second layer is curved and comprises a plurality of warp threads and a plurality of filling layers of weft threads and, said open weave provides that each of said warp threads alternates through a plurality of said filling layers;

said first layer comprises weft threads and warp threads which alternate through the weft threads of said first layer; and said intermediate links comprise connecting threads which enter into said open weave and alternate as warp threads among weft threads of said open weave, said connecting threads entering into said first layer and alternating as warp threads among weft threads of said first layer.

7. Structural element according to claim 6, wherein warp threads of said first fabric layer alternate among weft threads of said first fabric layer with a first pattern;

warp threads of said second fabric layer alternate among weft threads of said second fabric layer with a second pattern;

the thread of an individual one of said links alternate among weft threads of said first fabric layer with a third pattern different from said first pattern; and the thread of an individual one of said links alternates among weft threads of said second fabric layer with a fourth pattern different from said second pattern.

8. Structural element comprising a laminar fabric including a first fabric layer and a second fabric layer and intermediate links connecting said first layer and said second layer, the laminar fabric being composed of a high tenacity yarn of a fiber selected from the fiber group consisting of aramid, carbon, ceramic, and glass fibers;

wherein said structural element has a curvature with said first layer being located on a convex side of said curvature and with said second layer being located on a concave side of said curvature;

said second layer is formed of an open weave;

said second layer comprises a plurality of warp threads and a plurality of filing layers of weft threads and, said open weave provides that each of said warp threads alternates through a plurality of said filling layers;

said laminar fabric is impregnated with a resin which is cured to provide rigidity to said structural element;

said first layer comprises weft threads and warp threads which alternate through the weft threads of said first layer; and said intermediate links comprise connecting threads which enter into said open weave and alternate as warp threads among weft threads of said open weave, said connecting threads entering into said first layer and alternating as warp threads among weft threads of said first layer.

* * * * *